US008617383B2

(12) United States Patent
Prentice et al.

(10) Patent No.: US 8,617,383 B2
(45) Date of Patent: Dec. 31, 2013

(54) INTEGRATED HYDROCRACKING AND DEWAXING OF HYDROCARBONS

(75) Inventors: Krista Marie Prentice, Bethlehem, NJ (US); Michel Daage, Hellertown, PA (US); Ajit Bhaskar Dandekar, Bridgewater, NJ (US); Christopher Gordon Oliveri, Stewartsville, NJ (US); Rohit Vijay, Annandale, NJ (US); Stephen J. McCarthy, Center Valley, PA (US); Wenyih F. Lai, Bridgewater, NJ (US); Bradley R. Fingland, Annandale, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 234 days.

(21) Appl. No.: 13/169,616

(22) Filed: Jun. 27, 2011

(65) Prior Publication Data

US 2011/0315599 A1 Dec. 29, 2011

Related U.S. Application Data

(60) Provisional application No. 61/359,557, filed on Jun. 29, 2010.

(51) Int. Cl.

| | |
|---|---|
| ***C10G 45/64*** | (2006.01) |
| ***C10G 45/02*** | (2006.01) |
| ***C10G 65/02*** | (2006.01) |
| ***C10G 47/00*** | (2006.01) |

(52) U.S. Cl.
USPC ..... 208/57; 208/111.01; 208/209; 208/211; 208/212

(58) Field of Classification Search
USPC ..... 208/27, 46, 57, 109, 110, 111.01, 208 R, 208/209, 211, 212, 213, 308, 347
See application file for complete search history.

(56) References Cited

U.S. PATENT DOCUMENTS

| | | | | |
|---|---|---|---|---|
| 5,713,965 | A | 2/1998 | Foglia et al. | |
| 6,517,704 | B1 | 2/2003 | Carroll et al. | |
| 6,569,312 | B1 * | 5/2003 | Carroll et al. | 208/49 |
| 6,884,339 | B2 | 4/2005 | Benazzi et al. | |
| 7,300,900 | B2 | 11/2007 | Benazzi et al. | |
| 7,371,315 | B2 | 5/2008 | Benazzi et al. | |
| 2009/0019763 | A1 | 1/2009 | Ghonasgi et al. | |

OTHER PUBLICATIONS

Parkash, S, Refining Processes Handbook, 2003, Gulf Publishing, pp. 50, 69-108.*

Johnson, M Arvin F. L., "Estimation of the Zeolite Content of a Catalyst from Nitrogen Adsorption Isotherms", Journal of Catalysis, 52, 425-431 (1978).

* cited by examiner

*Primary Examiner* — Walter D Griffin
*Assistant Examiner* — Derek Mueller
(74) *Attorney, Agent, or Firm* — Robert A. Migliorini

(57) ABSTRACT

An integrated process for producing naphtha fuel, diesel fuel and/or lubricant base oils from feedstocks under sour conditions is provided. The ability to process feedstocks under higher sulfur and/or nitrogen conditions allows for reduced cost processing and increases the flexibility in selecting a suitable feedstock. The sour feed can be delivered to a catalytic dewaxing step without any separation of sulfur and nitrogen contaminants, or with only a high pressure separation so that the dewaxing still occurs under sour conditions. Various combinations of hydrotreating, catalytic dewaxing, hydrocracking, and hydrofinishing can be used to produce fuel products and lubricant base oil products.

39 Claims, 5 Drawing Sheets

INTEGRATED HYDROCRACKING AND DEWAXING OF HYDROCARBONS

CROSS-REFERENCE TO RELATED APPLICATIONS

This is a non-provisional application that claims priority to U.S. Provisional Patent Application No. 61/359,557 filed on Jun. 29, 2010, herein incorporated by reference in its entirety.

FIELD

This disclosure provides a system and a method for processing of sulfur- and/or nitrogen-containing feedstocks to produce diesel fuels and lubricating oil basestocks.

BACKGROUND

Hydrocracking of hydrocarbon feedstocks is often used to convert lower value hydrocarbon fractions into higher value products, such as conversion of vacuum gas oil (VGO) feedstocks to diesel fuel and lubricants. Typical hydrocracking reaction schemes can include an initial hydrotreatment step, a hydrocracking step, and a post hydrotreatment step. After these steps, the effluent can be fractionated to separate out a desired diesel fuel and/or lubricant oil basestock.

One method of classifying lubricating oil basestocks is that used by the American Petroleum Institute (API). API Group II basestocks have a saturates content of 90 wt % or greater, a sulfur content of not more than 0.03 wt % and a VI greater than 80 but less than 120. API Group III basestocks are the same as Group II basestocks except that the VI is at least 120. A process scheme such as the one detailed above is typically suitable for production of Group II and Group III basestocks from an appropriate feed.

U.S. Pat. No. 6,884,339 describes a method for processing a feed to produce a lubricant base oil and optionally distillate products. A feed is hydrotreated and then hydrocracked without intermediate separation. An example of the catalyst for hydrocracking can be a supported Y or beta zeolite. The catalyst also includes a hydro-dehydrogenating metal, such as a combination of Ni and Mo. The hydrotreated, hydrocracked effluent is then atmospherically distilled. The portion boiling above 340° C. is catalytically dewaxed in the presence of a bound molecular sieve that includes a hydro-dehydrogenating element. The molecular sieve can be ZSM-48, EU-2, EU-11, or ZBM-30. The hydro-dehydrogenating element can be a noble Group VIII metal, such as Pt or Pd.

U.S. Pat. No. 7,371,315 describes a method for producing a lubricant base oil and optionally distillate products. A feed is provided with a sulfur content of less than 1000 wppm. Optionally, the feed can be a hydrotreated feed. Optionally, the feed can be a hydrocracked feed, such as a feed hydrocracked in the presence of a zeolite Y-containing catalyst. The feed is converted on a noble metal on an acidic support. This entire converted feed can be dewaxed in the presence of a dewaxing catalyst.

U.S. Pat. No. 7,300,900 describes a catalyst and a method for using the catalyst to perform conversion on a hydrocarbon feed. The catalyst includes both a Y zeolite and a zeolite selected from ZBM-30, ZSM-48, EU-2, and EU-11. Examples are provided of a two stage process, with a first stage hydrotreatment of a feed to reduce the sulfur content of the feed to 15 wppm, followed by hydroprocessing using the catalyst containing the two zeolites. An option is also described where it appears that the effluent from a hydrotreatment stage is cascaded without separation to the dual-zeolite catalyst, but no example is provided of the sulfur level of the initial feed for such a process.

SUMMARY

In an embodiment, a method is provided for producing a diesel fuel and a lubricant basestock. The method includes contacting a feedstock with a hydrotreating catalyst under first effective hydrotreating conditions to produce a hydrotreated effluent; separating the hydrotreated effluent to form a gas phase portion and a remaining portion having at least a liquid phase; dewaxing the remaining portion of the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; hydrocracking the dewaxed effluent under effective hydrocracking conditions to form a hydroprocessed effluent; and fractionating the hydroprocessed effluent to form at least a naphtha product fraction, a diesel product fraction and a lubricant base oil product fraction. Optionally, the dewaxing catalyst can include at least one low surface area metal oxide, refractory binder.

In another embodiment, a method for producing a diesel fuel and a lubricant basestock is provided. The method includes contacting a feedstock with a hydrotreating catalyst under effective hydrotreating conditions to produce a hydrotreated effluent; dewaxing the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed hydrotreated effluent to form a gas phase portion and a remaining portion having at least a liquid phase; hydrocracking the remaining portion of dewaxed hydrotreated effluent under effective hydrocracking conditions to form a hydrocracked dewaxed hydrotreated effluent; and fractionating the hydrocracked dewaxed hydrotreated effluent to form at least a naphtha product fraction, a diesel product fraction and a lubricant base oil product fraction.

In another embodiment, a method for producing a diesel fuel and a lubricant basestock is provided. The method includes contacting a feedstock with a hydrotreating catalyst under first effective hydrotreating conditions to produce a hydrotreated effluent; dewaxing the hydrotreated effluent under first effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; hydrocracking at least a portion of the dewaxed effluent under first effective hydrocracking conditions to form a hydrocracked effluent; exposing at least a portion of the hydrocracked effluent to at least one additional hydroprocessing catalyst under one or more effective hydroprocessing conditions to form a hydroprocessed effluent, the one or more effective hydroprocessing conditions being selected from second effective dewaxing conditions and second effective hydrocracking conditions; and fractionating the hydroprocessed effluent to form at least a naphtha product fraction, a diesel product fraction, and a lubricant base oil product fraction. Optionally, the dewaxing catalyst can include at least one low surface area metal oxide, refractory binder.

In yet another embodiment, a method for producing a diesel fuel and a lubricant basestock is provided. The method includes contacting a feedstock with a hydrotreating catalyst under effective hydrotreating conditions to produce a hydrotreated effluent; separating the hydrotreated effluent to form a first gas phase portion and a first remaining portion having at least a liquid phase; dewaxing the first remaining portion of the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed hydrotreated effluent to form a second gas phase portion and a second remaining portion having at least a liquid phase; hydrocracking the remaining portion of the dewaxed hydrotreated effluent under effective hydrocracking conditions to form a hydrocracked dewaxed hydrotreated effluent; and fractionating the hydrocracked dewaxed hydrotreated effluent to form at least a naphtha product fraction, a diesel product fraction and a lubricant base oil product fraction. Optionally, the dewaxing catalyst can include at least one low surface area metal oxide, refractory binder.

In still yet another embodiment, a method for producing a diesel fuel and a lubricant basestock is provided. The method includes: contacting a feedstock with a hydrotreating catalyst under first effective hydrotreating conditions to produce a hydrotreated effluent; dewaxing the hydrotreated effluent under first effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed effluent to form a gas phase portion and a remaining portion having at least a liquid phase: hydrocracking at least a portion of the remaining portion of the dewaxed effluent under first effective hydrocracking conditions to form a hydrocracked effluent; exposing at least a portion of the hydrocracked effluent to at least one additional hydroprocessing catalyst under one or more effective hydroprocessing conditions to form a hydroprocessed effluent, the one or more effective hydroprocessing conditions being selected from second effective dewaxing conditions and second effective hydrocracking conditions; and fractionating the hydroprocessed effluent to form at least a naphtha product fraction, a diesel product fraction, and a lubricant base oil product fraction.

DETAILED DESCRIPTION

Figure 1:
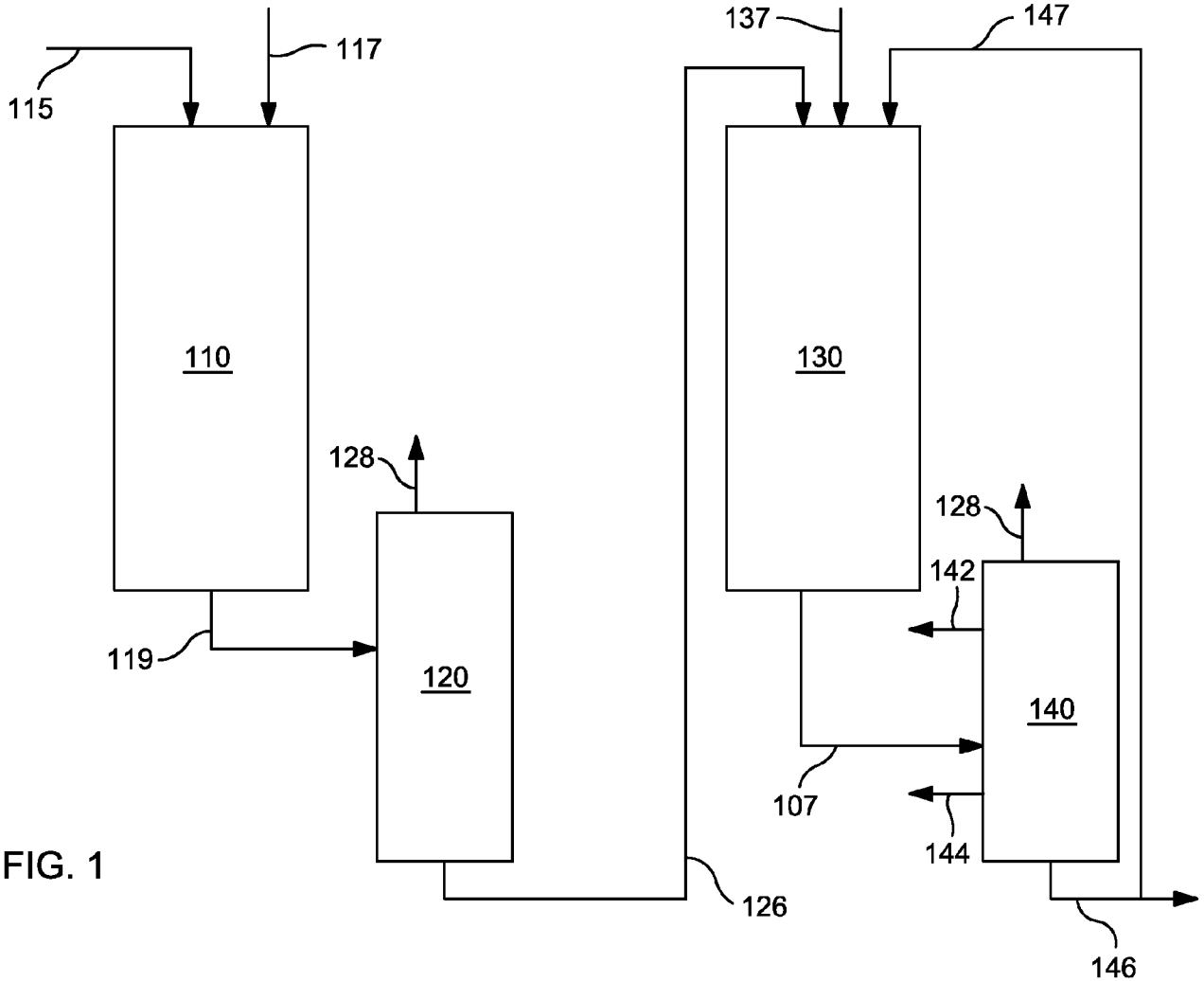
FIG. 1 schematically shows an example of a multi-stage reaction system according to an embodiment of the invention.

All numerical values within the detailed description and the claims herein are modified by "about" or "approximately" the indicated value, and take into account experimental error and variations that would be expected by a person having ordinary skill in the art.

Overview

One option for processing a heavier feed, such as a heavy distillate or gas oil type feed, is to use hydrocracking to convert a portion of the feed. Portions of the feed that are converted below a specified boiling point, such as a 700° F. (371° C.) portion that can be used for naphtha and diesel fuel products, while the remaining unconverted portions can be used as lubricant oil basestocks.

Improvements in diesel and/or lube basestock yield can be based in part on alternative configurations that are made possible by use of a dewaxing catalyst. For example, zeolite Y based hydrocracking catalysts are selective for cracking of cyclic and/or branched hydrocarbons. Paraffinic molecules with little or no branching may require severe hydrocracking conditions in order to achieve desired levels of conversion. This can result in overcracking of the cyclic and/or more heavily branched molecules in a feed. A catalytic dewaxing process can increase the branching of paraffinic molecules. This can increase the ability of a subsequent hydrocracking stage to convert the paraffinic molecules with increased numbers of branches to lower boiling point species.

In various embodiments, a dewaxing catalyst can be selected that is suitable for use in a sour or sweet environment while minimizing conversion of higher boiling molecules to naphtha and other less valuable species. One option can be to include a sour dewaxing stage as part of first sour stage prior to a first sweet hydrocracking stage. Alternatively, this benefit can be realized by having a combined sweet dewaxing and hydrocracking stage after a first sour hydrotreating stage. A high pressure separation stage can be used between sour and sweet stages to remove a portion of the gas phase contaminants, such as $NH_3$ or $H_2S$. Optionally, the effluent from the hydrocracking can be exposed to one or more additional dewaxing and/or hydrocracking stages or processes. Optionally, a hydrofinishing process can be used prior to fractionation of the hydroprocessed effluent.

The dewaxing catalysts used according to the invention can provide an activity advantage relative to conventional dewaxing catalysts in the presence of sulfur feeds. In the context of dewaxing, a sulfur feed can represent a feed containing at least 100 ppm by weight of sulfur, or at least 1000 ppm by weight of sulfur, or at least 2000 ppm by weight of sulfur, or at least 4000 ppm by weight of sulfur, or at least 40,000 ppm by weight of sulfur. The feed and hydrogen gas mixture can include greater than 1,000 ppm by weight of sulfur or more, or 5,000 ppm by weight of sulfur or more, or 15,000 ppm by weight of sulfur or more. In yet another embodiment, the sulfur may be present in the gas only, the liquid only or both. For the present disclosure, these sulfur levels are defined as the total combined sulfur in liquid and gas forms fed to the dewaxing stage in parts per million (ppm) by weight on the hydrotreated feedstock basis.

This advantage can be achieved by the use of a catalyst comprising a 10-member ring pore, one-dimensional zeolite in combination with a low surface area metal oxide refractory binder, both of which are selected to obtain a high ratio of micropore surface area to total surface area. Alternatively, the zeolite has a low silica to alumina ratio. As another alternative, the catalyst can comprise an unbound 10-member ring pore, one-dimensional zeolite. The dewaxing catalyst can further include a metal hydrogenation function, such as a Group VIII metal, preferably a Group VIII noble metal. Preferably, the dewaxing catalyst is a one-dimensional 10-member ring pore catalyst, such as ZSM-48 or ZSM-23.

The external surface area and the micropore surface area refer to one way of characterizing the total surface area of a catalyst. These surface areas are calculated based on analysis of nitrogen porosimetry data using the BET method for surface area measurement. (See, for example, Johnson, M. F. L., Jour. Catal., 52, 425 (1978).) The micropore surface area refers to surface area due to the unidimensional pores of the zeolite in the dewaxing catalyst. Only the zeolite in a catalyst will contribute to this portion of the surface area. The external surface area can be due to either zeolite or binder within a catalyst.

Feedstocks

A wide range of petroleum and chemical feedstocks can be hydroprocessed in accordance with the present invention. Suitable feedstocks include whole and reduced petroleum crudes, atmospheric and vacuum residua, propane deasphalted residua, e.g., brightstock, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, Fischer-Tropsch waxes, raffinates, and mixtures of these materials. Typical feeds would include, for example, vacuum gas oils boiling up to about 593° C. (about 1100° F.) and usually in the range of about 350° C. to about 500° C. (about 660° F. to about 935° F.) and, in this case, the proportion of diesel fuel produced is correspondingly greater. In some embodiments, the sulfur content of the feed can be at least 100 ppm by weight of sulfur, or at least 1000 ppm by weight of sulfur, or at least 2000 ppm by weight of sulfur, or at least 4000 ppm by weight of sulfur, or at least 40,000 ppm by weight of sulfur.

Note that for stages that are tolerant of a sour processing environment, a portion of the sulfur in a processing stage can be sulfur containing in a hydrogen treat gas stream. This can allow, for example, an effluent hydrogen stream from a hydroprocessing reaction that contains $H_2S$ as an impurity to be used as a hydrogen input to a sour environment process without removal of some or all of the $H_2S$. The hydrogen stream containing $H_2S$ as an impurity can be a partially cleaned recycled hydrogen stream from one of the stages of a process according to the invention, or the hydrogen stream can be from another refinery process.

Process Flow Schemes

In the discussion below, a stage can correspond to a single reactor or a plurality of reactors. Optionally, multiple parallel reactors can be used to perform one or more of the processes, or multiple parallel reactors can be used for all processes in a stage. Each stage and/or reactor can include one or more catalyst beds containing hydroprocessing catalyst. Note that a "bed" of catalyst in the discussion below can refer to a partial physical catalyst bed. For example, a catalyst bed within a reactor could be filled partially with a hydrocracking catalyst and partially with a dewaxing catalyst. For convenience in description, even though the two catalysts may be stacked together in a single catalyst bed, the hydrocracking catalyst and dewaxing catalyst can each be referred to conceptually as separate catalyst beds.

A variety of process flow schemes are available according to various embodiments of the invention. In one example, a feed can initially by hydrotreated by exposing the feed to one or more beds of hydrotreatment catalyst. The hydrotreated feed can then be dewaxed in the presence of one or more beds of dewaxing catalyst. The entire hydrotreated feed can be dewaxed, or a high pressure separation step can be used to remove a gas phase portion of the effluent. The hydrotreated, dewaxed feed can then be hydrocracked in the presence of one or more beds of hydrocracking catalyst. Once again, the entire effluent can be hydrocracked, or a remaining portion after a high pressure separation can be hydrocracked. The effluent from the hydrocracking stage can then optionally be dewaxed and/or hydrocracked in the presence of one or more additional catalyst beds. Alternatively, if only high pressure separation steps are used for any separations, the pressure of the hydroprocessed feed can be maintained during separation, which can reduce or eliminate the need for re-pressurization between the various processes.

After the hydrotreating, dewaxing, and/or hydrocracking, the hydroprocessed feed can be fractionated into a variety of products. One option for fractionation can be to separate the hydroprocessed feed into portions boiling above and below a desired conversion temperature, such as 700° F. (371° C.). In this option, the portion boiling below 371° C. corresponds to a portion containing naphtha boiling range product, diesel boiling range product, hydrocarbons lighter than a naphtha boiling range product, and contaminant gases generated during hydroprocessing such as $H_2S$ and $NH_3$. Optionally, one or more of these various product streams can be separated out as a distinct product by the fractionation, or separation of these products from a portion boiling below 371° C. can occur in a later fractionation step. Optionally, the portion boiling below 371° C. can be fractionated to also include a kerosene product.

The portion boiling above 371° C. corresponds to a bottoms fraction. The bottoms fraction can be used as a lubricant oil base product. Alternatively, this bottoms fraction can be passed into another hydroprocessing stage that includes one or more types of hydroprocessing catalysts. The second stage can include one or more beds of a hydrocracking catalyst, one or more beds of a dewaxing catalyst, and optionally one or more beds of a hydrofinishing or aromatic saturation catalyst. The reaction conditions for hydroprocessing in the second stage can be the same as or different from the conditions used in the first stage. Because of the hydrotreatment processes in the first stage and the fractionation, the sulfur content of the bottoms fraction, on a combined gas and liquid sulfur basis, can be 1000 wppm or less, or about 500 wppm or less, or about 100 wppm or less, or about 50 wppm or less, or about 10 wppm or less.

Still another option can be to include one or more beds of hydrofinishing or aromatic saturation catalyst in a separate third stage and/or reactor. In the discussion below, a reference to hydrofinishing is understood to refer to either hydrofinishing or aromatic saturation, or to having separate hydrofinishing and aromatic saturation processes. In situations where a hydrofinishing process is desirable for reducing the amount of aromatics in a feed, it can be desirable to operate the hydrofinishing process at a temperature that is colder than the temperature in the prior hydroprocessing stages. For example, it may be desirable to operate a dewaxing process at a temperature above 300° C. while operating a hydrofinishing process at a temperature below 280° C. One way to facilitate having a temperature difference between a dewaxing and/or hydrocracking process and a subsequent hydrofinishing process is to house the catalyst beds in separate reactors. A hydrofinishing or aromatic saturation process can be included either before or after fractionation of a hydroprocessed feed.

FIG. 1 shows an example of a general reaction system that utilizes two reaction stages suitable for use in various embodiments of the invention. In FIG. 1, a reaction system is shown that includes a first reaction stage 110, a high pressure separation stage 120, and a second reaction stage 130. Both the first reaction stage 110 and second reaction stage 130 are represented in FIG. 1 as single reactors. Alternatively, any convenient number of reactors can be used for the first stage 110 and/or the second stage 130. The high pressure separation stage 120 is a stage capable of performing a separation of gas phase products from the effluent of the first stage at a pressure comparable to the inlet pressure for second stage 130. The pressure in the high pressure separation stage 120 can be at least the inlet pressure for the second stage 130, or the pressure can be within 5% of the pressure for the high pressure separation stage, or within 10%.

A suitable feedstock 115 is introduced into first reaction stage 110 along with a hydrogen-containing stream 117. The feedstock is hydroprocessed in the presence of one or more catalyst beds under effective conditions. The effluent 119 from first reaction stage 110 is passed into high pressure separation stage 120. The separation stage 120 can produce a gas phase fraction 128 and a remaining effluent fraction 126. The gas phase fraction can include both contaminants such as $H_2S$ or $NH_3$ as well as low boiling point species such as $C_1$-$C_4$ hydrocarbons. The remaining effluent fraction 126 from the separation stage is used as input to the second hydroprocessing stage 130, along with a second hydrogen stream 137. The remaining effluent fraction is hydroprocessed in second stage 130. In one form, the second reaction stage 230 may be a hydroprocessing stage loaded with a hydrodewaxing and a hydrocracking catalyst. At least a portion of the effluent from second stage 130 can be sent to a fractionator 140 for production of one or more products, such as a second naphtha product 142, a second diesel product 144, or a lubricant base oil product 146. Another portion of the bottoms from the fractionator 140 can optionally be recycled back 147 to second stage 130.

Figure 5:
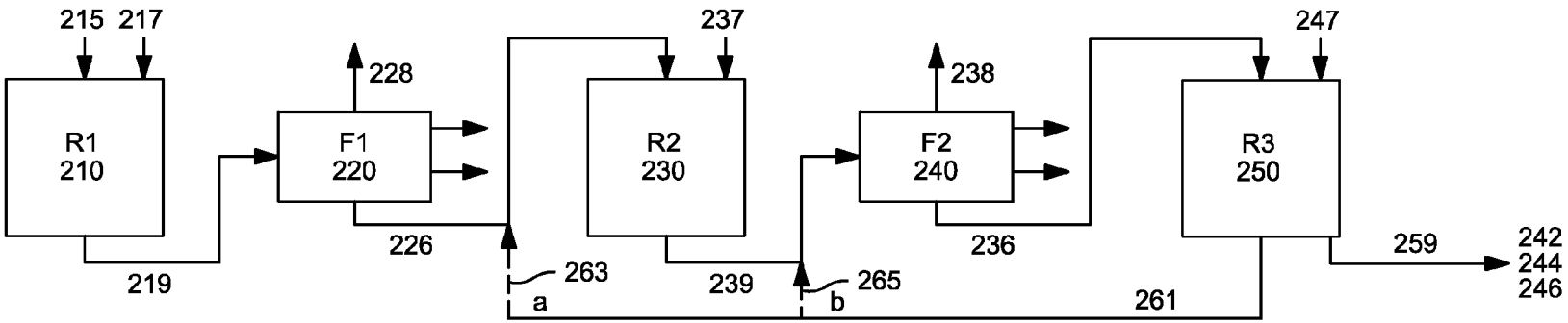
FIG. 5 schematically shows an example of a multi-stage reaction system according to an alternative embodiment of the invention.

FIG. 5 shows an example of a general reaction system that utilizes three reaction stages suitable for use in alternative embodiments of the invention. In FIG. 5, a reaction system is shown that includes a first reaction stage 210, a first high pressure separation stage 220, a second reaction stage 230, a second high pressure separation stage 240, and a third reaction stage 250. The first reaction stage 210, second reaction stage 230 and third reaction stage 250 are represented in FIG. 5 as single reactors. Alternatively, any convenient number of reactors can be used for the first stage 210, second stage 230 and/or third stage 250. The first high pressure separation stage 220 is a stage capable of performing a separation of gas phase products from the effluent of the first stage 210 at a pressure comparable to the inlet pressure for the second stage 230. The second high pressure separation stage 240 is a stage capable of performing a separation of gas phase products from the effluent of the second stage 230 at a pressure comparable to the inlet pressure for the third stage 250. The pressure in the first and second high pressure separation stages 220, 240 can be at least the inlet pressure for the second stage 230 and third stage 250 respectively, or the pressure can be within 5% of the pressure for the high pressure separation stage, or within 10%.

A suitable feedstock 215 is introduced into first reaction stage 210 along with a hydrogen-containing stream 217. The feedstock is hydroprocessed in the presence of one or more catalyst beds under effective conditions. In one form, the first reaction stage 210 may be a conventional hydrotreating reactor. The effluent 219 from first reaction stage 210 is passed into first high pressure separation stage 220. The separation stage 220 can produce a first gas phase fraction 228 and a remaining first effluent fraction 226. In one form, the first high pressure separation stage 230 is a high pressure separator. The first gas phase fraction 228 can include both contaminants such as $H_2S$ or $NH_3$ as well as low boiling point species such as $C_1$-$C_4$ hydrocarbons. The remaining first effluent fraction 226 from the separation stage is used as input to the second reaction stage hydroprocessing stage 230 along with a second hydrogen stream 237. The remaining first effluent fraction 226 is hydroprocessed in the second reaction stage 230. In one form, the second reaction stage 230 may be a hydrodewaxing reactor loaded with a dewaxing catalyst. The second effluent 239 from the second reaction stage 230 is passed into second high pressure separation stage 240. The second separation stage 240 can produce a second gas phase fraction 238 and a remaining second effluent fraction 236. In one form, the second high pressure separation stage 240 is a high pressure separator. The second gas phase fraction 238 can again include both contaminants such as $H_2S$ or $NH_3$ as well as low boiling point species such as $C_1$-$C_4$ hydrocarbons. The remaining second effluent fraction 236 from the second separation stage 240 is used as input to the third reaction stage/hydroprocessing stage 250, along with a third hydrogen stream 247. The remaining second effluent fraction 236 is hydroprocessed in the third reaction stage 250. In one form, the third reaction stage 230 may be a hydrocracking reactor loaded with a hydrocracking catalyst. At least a portion of the effluent 259 from third reaction stage 250 can then be sent to a fractionator (not shown) for production of one or more products, such as a naphtha product 242, a diesel product 244, or a lubricant base oil product 246. Another portion of the bottoms 261 from the third reaction stage 250 can optionally be recycled back to either the second reaction stage 230 via recycle stream 263 or the second separation stage 240 via recycle stream 265 or a combination thereof. Recycle stream 263 is utilized when the product from third reaction stage 250 does not meet cold flow property specifications of the diesel product 244 or lubricant base oil product 246 and further dewaxing is necessary to meet the specifications. Recycle stream 265 is utilized when the product from third reaction stage 250 does not need further dewaxing to meet the cold flow property specifications of the diesel product 244 or lubricant base oil product 246. In another form, the process configuration of FIG. 5 may include a hydrofinishing reactor after the third reaction stage and prior to the fractionator. The hydrofinishing reactor may be loading with a hydrofinishing catalyst and run at effective reaction conditions.

The process configuration of FIG. 5 maximizes the diesel yield in a 3-stage hydrocracker. The configuration produces a diesel product possessing superior cold flow properties. In contrast with the current state of the art, the diesel product coming from a hydrocracker may not produce diesel with ideal cold flow properties and would have to be subsequently dewaxed to improve product quality. With the process configuration of FIG. 5, all the diesel product would be sufficiently dewaxed before exiting the system to meet cold flow property requirements.

Figure 2:
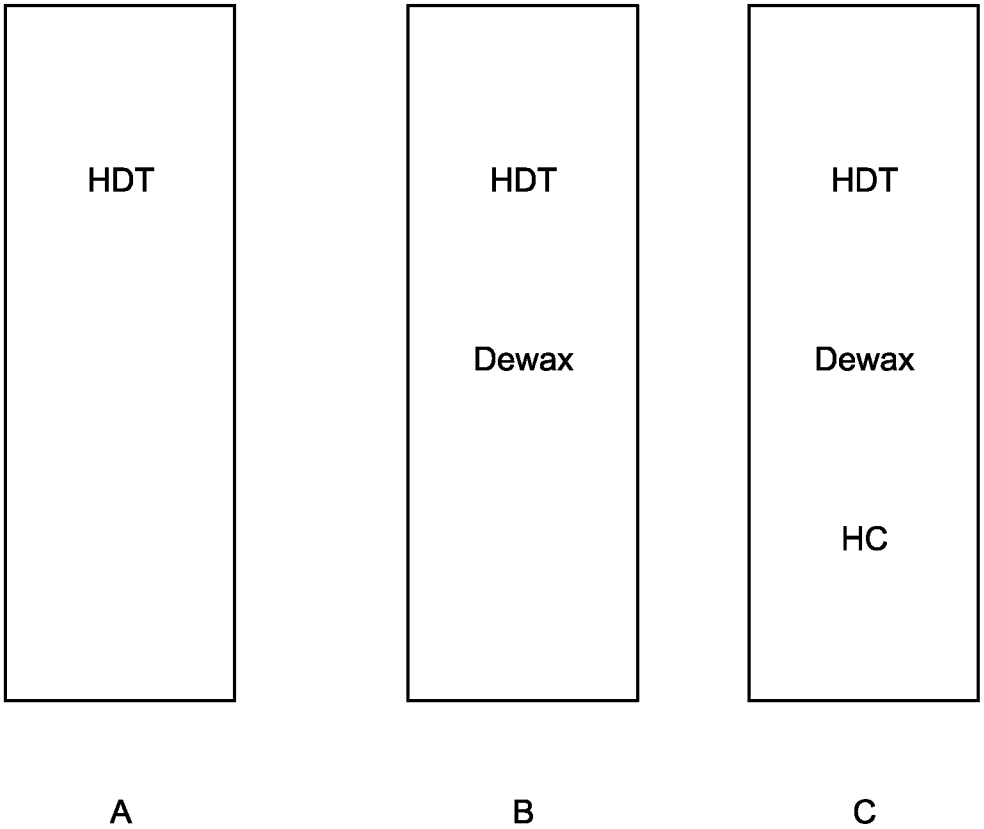
FIG. 2 schematically shows examples of catalyst configurations for a first reaction stage.

FIG. 2 shows examples of four catalyst configurations (A-C) that can be employed in a first stage under sour conditions. Configuration A shows a first reaction stage that includes hydrotreating catalyst. Configuration B shows a first reaction stage that includes beds of a hydrotreating catalyst and a dewaxing catalyst. Configuration C shows a first reaction stage that includes beds of a hydrotreating catalyst, a dewaxing catalyst, and a hydrocracking. Note that the reference here to "beds" of catalyst can include embodiments where a catalyst is provided as a portion of a physical bed within a stage.

Figure 3:
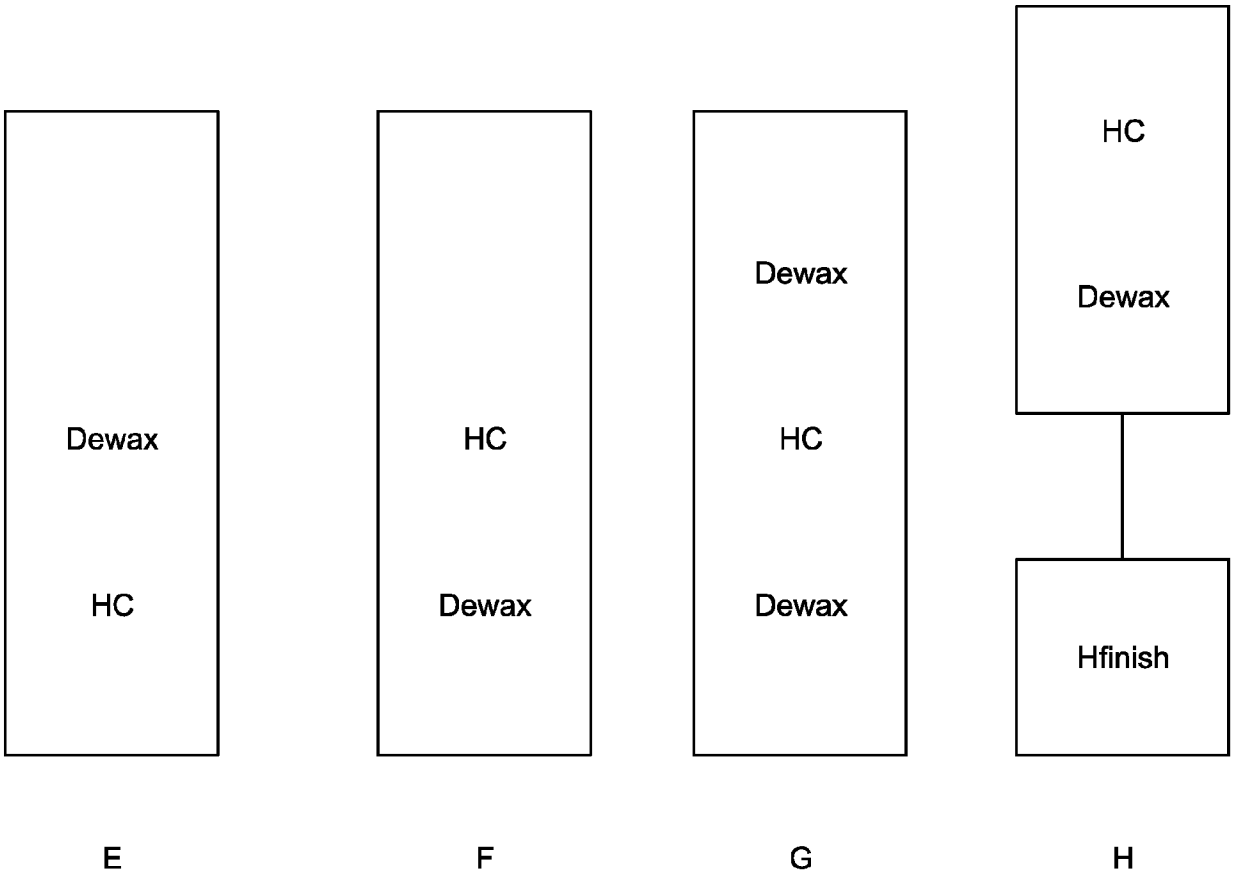
FIG. 3 schematically shows examples of catalyst configurations for a second reaction stage.

FIG. 3 shows examples of catalyst configurations (E, F, G, and H) that can be employed in a second stage. Configuration E shows a second reaction stage that includes beds of dewaxing catalyst and hydrocracking catalyst. Configuration F shows a second reaction stage that includes beds of hydrocracking catalyst and dewaxing catalyst. Configuration G shows a second reaction stage that includes beds of dewaxing catalyst, hydrocracking catalyst, and more dewaxing catalyst. Note that in Configuration G, the second set of beds of dewaxing catalyst can include the same type(s) of dewaxing catalyst as the first group of beds or different type(s) of catalyst.

Optionally, a final bed of hydrofinishing catalyst could be added to any of Configurations E, F, or G. Configuration H shows this type of configuration, with beds of hydrocracking, dewaxing, and hydrofinishing catalyst. As noted above, each stage can include one or more reactors, so one option can be to house the hydrofinishing catalyst in a separate reactor from the catalysts shown for Configurations E, F, or G. This separate reactor is schematically represented in Configuration H. Note that the hydrofinishing beds can be included either before or after fractionation of the effluent from the second (or non-sour) reaction stage. As a result, hydrofinishing can be performed on a portion of the effluent from the second stage if desired.

Configurations E, F, and G can be used to make both a fuel product and a lubricant base oil product from the remaining effluent from the first stage. The yield of diesel fuel product can be higher for Configuration F relative to Configuration E, and higher still for Configuration G. Of course, the relative diesel yield of the configurations can be modified, such as by recycling a portion of the bottoms for further conversion.

Any of Configurations A, B, or C can be matched with any of Configurations E, F, or G in a two stage reaction system, such as the two stage system shown in FIG. 1. The bottoms portion from a second stage of any of the above combinations can have an appropriate pour point for use as a lubricant oil base stock, such as a Group II, Group II+, or Group III base stock. However, the aromatics content may be too high depending on the nature of the feed and the selected reaction conditions. Therefore a hydrofinishing stage can optionally be used with any of the combinations.

It is noted that some combinations of Configuration B, C, or D with a configuration from Configuration E, F, or G will result in the final bed of the first stage being of a similar type of catalyst to the initial bed of the second stage. For example, a combination of Configuration C with Configuration G would result in having dewaxing catalyst in both the last bed of the first stage and in the initial bed of the second stage. This situation still is beneficial, as the consecutive stages can allow less severe reaction conditions to be selected in each stage while still achieving desired levels of improvement in cold flow properties. This is in addition to the benefit of having dewaxing catalyst in the first stage to improve the cold flow properties of a diesel product separated from the effluent of the first stage.

Note that Configurations E, F, G, or H can optionally be expanded to include still more catalyst beds. For example, one or more additional dewaxing and/or hydrocracking catalyst beds can be included after the final dewaxing or catalyst bed shown in a Configuration. Additional beds can be included in any convenient order. For example, one possible extension for Configuration E would be to have a series of alternating beds of dewaxing catalyst and hydrocracking catalyst. For a series of four beds, this could result in a series of dewaxing-hydrocracking-dewaxing-hydrocracking. A similar extension of Configuration F could be used to make a series of hydrocracking-dewaxing-hydrocracking dewaxing. A hydrofinishing catalyst bed could then be added after the final additional hydrocracking or dewaxing catalyst bed.

Any combination of Configuration A, B, or C with Configuration E, F, G, or H can provide a process with improved performance for producing fuel and lubricant base oil products. Any of the above configurations can be used to hydrotreat and then dewax a feed under sour conditions. The feed is then hydrocracked. By including a dewaxing stage prior to hydrocracking, the effectiveness of the hydrocracking process for cracking of paraffinic species can be increased. Optionally, this can allow for a reduction in the temperatures needed during hydrocracking to achieve a desired level of conversion. Alternatively, this can be used to increase the diesel yield from a feed at a given set of process conditions. Including an optional high pressure separation can provide a further benefit of reducing the severity of processing conditions without depressurizing the feed. This can avoid having to add compressors and other equipment prior to each process or stage.

If a lubricant base stock product is desired, the lubricant base stock product can be further fractionated to form a plurality of products. For example, lubricant base stock products can be made corresponding to a 2 cSt cut, a 4 cSt cut, a 6 cSt cut, and/or a cut having a viscosity higher than 6 cSt. For example, a lubricant base oil product fraction having a viscosity of at least 2 cSt can be a fraction suitable for use in low pour point application such as transformer oils, low temperature hydraulic oils, or automatic transmission fluid. A lubricant base oil product fraction having a viscosity of at least 4 cSt can be a fraction having a controlled volatility and low pour point, such that the fraction is suitable for engine oils made according to SAE J300 in 0W- or 5W- or 10W-grades. This fractionation can be performed at the time the diesel (or other fuel) product from the second stage is separated from the lubricant base stock product, or the fractionation can occur at a later time. Any hydrofinishing and/or aromatic saturation can occur either before or after fractionation. After fractionation, a lubricant base oil product fraction can be combined with appropriate additives for use as an engine oil or in another lubrication service.

Hydrotreatment Conditions

Hydrotreatment is typically used to reduce the sulfur, nitrogen, and aromatic content of a feed. Hydrotreating conditions can include temperatures of 200° C. to 450° C., or 315° C. to 425° C.; pressures of 250 psig (1.8 MPa) to 5000 psig (34.6 MPa) or 300 psig (2.1 MPa) to 3000 psig (20.8 MPa); Liquid Hourly Space Velocities (LHSV) of 0.2-10 $h^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

Hydrotreating catalysts are typically those containing Group VIB metals (based on the Periodic Table published by Fisher Scientific), and non-noble Group VIII metals, i.e., iron, cobalt and nickel and mixtures thereof. These metals or mixtures of metals are typically present as oxides or sulfides on refractory metal oxide supports. Suitable metal oxide supports include low acidic oxides such as silica, alumina or titania, preferably alumina. Preferred aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. The supports are preferably not promoted with a halogen such as fluorine as this generally increases the acidity of the support.

Preferred metal catalysts include cobalt/molybdenum (1-10% Co as oxide, 10-40% Mo as oxide), nickel/molybdenum (1-10% Ni as oxide, 10-40% Co as oxide), or nickel/tungsten (1-10% Ni as oxide, 10-40% W as oxide) on alumina Examples of suitable nickel/molybdenum catalysts include KF-840, KF-848, or a stacked bed of KF-848 or KF-840 and Nebula-20.

Alternatively, the hydrotreating catalyst can be a bulk metal catalyst, or a combination of stacked beds of supported and bulk metal catalyst. By bulk metal, it is meant that the catalysts are unsupported wherein the bulk catalyst particles comprise 30-100 wt. % of at least one Group VIII non-noble metal and at least one Group VIB metal, based on the total weight of the bulk catalyst particles, calculated as metal oxides and wherein the bulk catalyst particles have a surface area of at least 10 $m^2/g$. It is furthermore preferred that the bulk metal hydrotreating catalysts used herein comprise about 50 to about 100 wt %, and even more preferably about 70 to about 100 wt %, of at least one Group VIII non-noble metal and at least one Group VIB metal, based on the total weight of the particles, calculated as metal oxides. The amount of Group VIB and Group VIII non-noble metals can easily be determined VIB TEM-EDX.

Bulk catalyst compositions comprising one Group VIII non-noble metal and two Group VIB metals are preferred. It has been found that in this case, the bulk catalyst particles are sintering-resistant. Thus the active surface area of the bulk catalyst particles is maintained during use. The molar ratio of Group VIB to Group VIII non-noble metals ranges generally from 10:1-1:10 and preferably from 3:1-1:3. In the case of a core-shell structured particle, these ratios of course apply to the metals contained in the shell. If more than one Group VIB metal is contained in the bulk catalyst particles, the ratio of the different Group VIB metals is generally not critical. The same holds when more than one Group VIII non-noble metal is applied. In the case where molybdenum and tungsten are present as Group VIB metals, the molybenum:tungsten ratio preferably lies in the range of 9:1-1:9. Preferably the Group VIII non-noble metal comprises nickel and/or cobalt. It is further preferred that the Group VIB metal comprises a combination of molybdenum and tungsten. Preferably, combinations of nickel/molybdenum/tungsten and cobalt/molybdenum/tungsten and nickel/cobalt/molybdenum/tungsten are used. These types of precipitates appear to be sinter-resistant. Thus, the active surface area of the precipitate is maintained during use. The metals are preferably present as oxidic compounds of the corresponding metals, or if the catalyst composition has been sulfided, sulfidic compounds of the corresponding metals.

It is also preferred that the bulk metal hydrotreating catalysts used herein have a surface area of at least 50 $m^2/g$ and more preferably of at least 100 $m^2/g$. It is also desired that the pore size distribution of the bulk metal hydrotreating catalysts be approximately the same as the one of conventional hydrotreating catalysts. Bulk metal hydrotreating catalysts have a pore volume of 0.05-5 ml/g, or of 0.1-4 ml/g, or of 0.1-3 ml/g, or of 0.1-2 ml/g determined by nitrogen adsorption. Preferably, pores smaller than 1 nm are not present. The bulk metal hydrotreating catalysts can have a median diameter of at least 50 nm, or at least 100 nm. The bulk metal hydrotreating catalysts can have a median diameter of not more than 5000 μm, or not more than 3000 μm. In an embodiment, the median particle diameter lies in the range of 0.1-50 μm and most preferably in the range of 0.5-50 μm.

Optionally, one or more beds of hydrotreatment catalyst can be located downstream from a hydrocracking catalyst bed and/or a dewaxing catalyst bed in the first stage. For these optional beds of hydrotreatment catalyst, the hydrotreatment conditions can be selected to be similar to the conditions above, or the conditions can be selected independently.

Hydrocracking Conditions

Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica.

A hydrocracking process in the first stage (or otherwise under sour conditions) can be carried out at temperatures of 200° C. to 450° C., hydrogen partial pressures of from 250 psig to 5000 psig (1.8 MPa to 34.6 MPa), liquid hourly space velocities of from 0.2 $h^{-1}$ to 10 $h^{-1}$, and hydrogen treat gas rates of from 35.6 $m^3/m^3$ to 1781 $m^3/m^3$ (200 SCF/B to 10,000 SCF/B). Typically, in most cases, the conditions will have temperatures in the range of 300° C. to 450° C., hydrogen partial pressures of from 500 psig to 2000 psig (3.5 MPa-13.9 MPa), liquid hourly space velocities of from 0.3 $h^{-1}$ to 2 $h^{-1}$ and hydrogen treat gas rates of from 213 $m^3/m^3$ to 1068 $m^3/m^3$ (1200 SCF/B to 6000 SCF/B).

A hydrocracking process in a second stage (or other stage after a high pressure separation) can be performed under conditions similar to those used for a first stage hydrocracking process, or the conditions can be different. In an embodiment, the conditions in a second stage can have less severe conditions than a hydrocracking process in a first stage. The temperature in the hydrocracking process can be 10° C. less than the temperature for a hydrocracking process in the first stage, or 20° C. less, or 30° C. less. The pressure for a hydrocracking process in a second stage can be 100 psig (690 kPa) less than a hydrocracking process in the first stage, or 200 psig (1380 kPa) less, or 300 psig (2070 kPa) less.

Hydrofinishing and/or Aromatic Saturation Process

In some embodiments, a hydrofinishing and/or aromatic saturation process can also be provided. The hydrofinishing and/or aromatic saturation can occur after the last hydrocracking or dewaxing stage. The hydrofinishing and/or aromatic saturation can occur either before or after fractionation. If hydrofinishing and/or aromatic saturation occurs after fractionation, the hydrofinishing can be performed on one or more portions of the fractionated product, such as being performed on one or more lubricant base stock portions. Alternatively, the entire effluent from the last hydrocracking or dewaxing process can be hydrofinished and/or undergo aromatic saturation.

In some situations, a hydrofinishing process and an aromatic saturation process can refer to a single process performed using the same catalyst. Alternatively, one type of catalyst or catalyst system can be provided to perform aromatic saturation, while a second catalyst or catalyst system can be used for hydrofinishing. Typically a hydrofinishing and/or aromatic saturation process will be performed in a separate reactor from dewaxing or hydrocracking processes for practical reasons, such as facilitating use of a lower temperature for the hydrofinishing or aromatic saturation process. However, an additional hydrofinishing reactor following a hydrocracking or dewaxing process but prior to fractionation could still be considered part of a second stage of a reaction system conceptually.

Hydrofinishing and/or aromatic saturation catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41. If separate catalysts are used for aromatic saturation and hydrofinishing, an aromatic saturation catalyst can be selected based on activity and/or selectivity for aromatic saturation, while a hydrofinishing catalyst can be selected based on activity for improving product specifications, such as product color and polynuclear aromatic reduction.

Hydrofinishing conditions can include temperatures from about 125° C. to about 425° C., preferably about 180° C. to about 280° C., total pressures from about 500 psig (3.4 MPa) to about 3000 psig (20.7 MPa), preferably about 1500 psig (10.3 MPa) to about 2500 psig (17.2 MPa), and liquid hourly space velocity from about 0.1 $hf^{-1}$ to about 5 $hf^{-1}$ LHSV, preferably about 0.5 $hr^{-1}$ to about 1.5 $hr^{-1}$.

Dewaxing Process

In various embodiments, catalytic dewaxing can be included as part of the hydroprocessing stages. This can be part of a first stage prior to any separation, or in a second stage after a high pressure separation. If a separation does not occur in the first stage, any sulfur in the feed at the beginning of the stage will still be in the effluent that is passed to the catalytic dewaxing step in some form. For example, consider a first stage that includes hydrotreatment catalyst and dewaxing catalyst. A portion of the organic sulfur in the feed to the stage will be converted to $H_2S$ during hydrotreating. Similarly, organic nitrogen in the feed will be converted to ammonia. However, without a separation step, the $H_2S$ and $NH_3$ formed during hydrotreating will travel with the effluent to the catalytic dewaxing stage. The lack of a separation step also means that any light gases ($C_1$-$C_4$) formed during hydrocracking will still be present in the effluent. The total combined sulfur from the hydrotreating process in both organic liquid form and gas phase (hydrogen sulfide) may be greater than 1,000 ppm by weight, or at least 2,000 ppm by weight, or at least 5,000 ppm by weight, or at least 10,000 ppm by weight, or at least 20,000 ppm by weight, or at least 40,000 ppm by weight. For the present disclosure, these sulfur levels are defined in terms of the total combined sulfur in liquid and gas forms fed to the dewaxing stage in parts per million (ppm) by weight on the hydrotreated feedstock basis.

Elimination of a separation step in the first reaction stage is enabled in part by the ability of a dewaxing catalyst to maintain catalytic activity in the presence of elevated levels of nitrogen and sulfur. Conventional catalysts often require pretreatment of a feedstream to reduce the sulfur content to less than a few hundred ppm. By contrast, hydrocarbon feedstreams containing up to 4.0 wt % of sulfur or more can be effectively processed using the inventive catalysts. In an embodiment, the total combined sulfur content in liquid and gas forms of the hydrogen containing gas and hydrotreated feedstock can be at least 0.1 wt %, or at least 0.2 wt %, or at least 0.4 wt %, or at least 0.5 wt %, or at least 1 wt %, or at least 2 wt %, or at least 4 wt %. Sulfur content may be measured by standard ASTM methods D2622.

Hydrogen treat gas circulation loops and make-up gas can be configured and controlled in any number of ways. In the direct cascade, treat gas enters the hydrotreating reactor and can be once through or circulated by compressor from high pressure flash drums at the back end of the hydrocracking and/or dewaxing section of the unit. In circulation mode, make-up gas can be put into the unit anywhere in the high pressure circuit preferably into the hydrocracking/dewaxing reactor zone. In circulation mode, the treat gas may be scrubbed with amine, or any other suitable solution, to remove $H_2S$ and $NH_3$. In another form, the treat gas can be recycled without cleaning or scrubbing. Alternately, the liquid effluent may be combined with any hydrogen containing gas, including but not limited to $H_2S$ containing gas.

Preferably, the dewaxing catalysts according to the invention are zeolites that perform dewaxing primarily by isomerizing a hydrocarbon feedstock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. ZSM-48 is most preferred. Note that a zeolite having the ZSM-23 structure with a silica to alumina ratio of from about 20:1 to about 40:1 can sometimes be referred to as SSZ-32. Other molecular sieves that are isostructural with the above materials include Theta-1, NU-10, EU-13, KZ-1, and NU-23.

In various embodiments, the catalysts according to the invention further include a metal hydrogenation component. The metal hydrogenation component is typically a Group VI and/or a Group VIII metal. Preferably, the metal hydrogenation component is a Group VIII noble metal. Preferably, the metal hydrogenation component is Pt, Pd, or a mixture thereof. In an alternative preferred embodiment, the metal hydrogenation component can be a combination of a non-noble Group VIII metal with a Group VI metal. Suitable combinations can include Ni, Co, or Fe with Mo or W, preferably Ni with Mo or W.

The metal hydrogenation component may be added to the catalyst in any convenient manner. One technique for adding the metal hydrogenation component is by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor is added to a mixture of zeolite (or zeolite and binder) prior to extrusion.

The amount of metal in the catalyst can be at least 0.1 wt % based on catalyst, or at least 0.15 wt %, or at least 0.2 wt %, or at least 0.25 wt %, or at least 0.3 wt %, or at least 0.5 wt % based on catalyst. The amount of metal in the catalyst can be 20 wt % or less based on catalyst, or 10 wt % or less, or 5 wt % or less, or 2.5 wt % or less, or 1 wt % or less. For embodiments where the metal is Pt, Pd, another Group VIII noble metal, or a combination thereof, the amount of metal can be from 0.1 to 5 wt %, preferably from 0.1 to 2 wt %, or 0.25 to 1.8 wt %, or 0.4 to 1.5 wt %. For embodiments where the metal is a combination of a non-noble Group VIII metal with a Group VI metal, the combined amount of metal can be from 0.5 wt % to 20 wt %, or 1 wt % to 15 wt %, or 2.5 wt % to 10 wt %.

Preferably, the dewaxing catalysts used in processes according to the invention are catalysts with a low ratio of silica to alumina. For example, for ZSM-48, the ratio of silica to alumina in the zeolite can be less than 200:1, or less than 110:1, or less than 100:1, or less than 90:1, or less than 80:1. In various embodiments, the ratio of silica to alumina can be from 30:1 to 200:1, 60:1 to 110:1, or 70:1 to 100:1.

The dewaxing catalysts useful in processes according to the invention can also include a binder. In some embodiments, the dewaxing catalysts used in process according to the invention are formulated using a low surface area binder, a low surface area binder represents a binder with a surface area of 100 $m^2/g$ or less, or 80 $m^2/g$ or less, or 70 $m^2/g$ or less.

Alternatively, the binder and the zeolite particle size are selected to provide a catalyst with a desired ratio of micropore surface area to total surface area. In dewaxing catalysts used according to the invention, the micropore surface area corresponds to surface area from the unidimensional pores of zeolites in the dewaxing catalyst. The total surface corresponds to the micropore surface area plus the external surface area. Any binder used in the catalyst will not contribute to the micropore surface area and will not significantly increase the total surface area of the catalyst. The external surface area represents the balance of the surface area of the total catalyst minus the micropore surface area. Both the binder and zeolite can contribute to the value of the external surface area. Preferably, the ratio of micropore surface area to total surface area for a dewaxing catalyst will be equal to or greater than 25%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can also be used to modify the extrusion flow properties of the zeolite and binder mixture. The amount of framework alumina in the catalyst may range from 0.1 to 3.33 wt %, or 0.1 to 2.7 wt %, or 0.2 to 2 wt %, or 0.3 to 1 wt %.

In yet another embodiment, a binder composed of two or more metal oxides can also be used. In such an embodiment, the weight percentage of the low surface area binder is preferably greater than the weight percentage of the higher surface area binder.

Alternatively, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

In yet another embodiment, the dewaxing catalyst is self-bound and does not contain a binder.

Process conditions in a catalytic dewaxing zone in a sour environment can include a temperature of from 200 to 450° C., preferably 270 to 400° C., a hydrogen partial pressure of from 1.8 to 34.6 mPa (250 to 5000 psi), preferably 4.8 to 20.8 mPa, a liquid hourly space velocity of from 0.2 to 10 v/v/hr, preferably 0.5 to 3.0, and a hydrogen circulation rate of from 35.6 to 1781 $m^3/m^3$ (200 to 10,000 scf/B), preferably 178 to 890.6 $m^3/m^3$ (1000 to 5000 scf/B).

For dewaxing in the second stage (or other environment after a high pressure separation), the dewaxing catalyst conditions can be similar to those for a sour environment. In an embodiment, the conditions in a second stage can have less severe conditions than a dewaxing process in a first stage. The temperature in the dewaxing process can be 10° C. less than the temperature for a dewaxing process in the first stage, or 20° C. less, or 30° C. less. The pressure for a dewaxing process in a second stage can be 100 psig (690 kPa) less than a dewaxing process in the first stage, or 200 psig (1380 kPa) less, or 300 psig (2070 kPa) less.

Dewaxing Catalyst Synthesis

In one form the of the present disclosure, the catalytic dewaxing catalyst includes from 0.1 wt % to 3.33 wt % framework alumina, 0.1 wt % to 5 wt % Pt, 200:1 to 30:1 $SiO_2$:$Al_2O_3$ ratio and at least one low surface area, refractory metal oxide binder with a surface area of 100 $m^2/g$ or less.

One example of a molecular sieve suitable for use in the claimed invention is ZSM-48 with a $SiO_2$:$Al_2O_3$ ratio of less than 110, preferably from about 70 to about 110. In the embodiments below, ZSM-48 crystals will be described variously in terms of "as-synthesized" crystals that still contain the (200:1 or less $SiO_2$:$Al_2O_3$ ratio) organic template; calcined crystals, such as Na-form ZSM-48 crystals; or calcined and ion-exchanged crystals, such as H-form ZSM-48 crystals.

The ZSM-48 crystals after removal of the structural directing agent have a particular morphology and a molar composition according to the general formula:

$$(n)SiO_2:Al_2O_3$$

where n is from 70 to 110, preferably 80 to 100, more preferably 85 to 95. In another embodiment, n is at least 70, or at least 80, or at least 85. In yet another embodiment, n is 110 or less, or 100 or less, or 95 or less. In still other embodiments, Si may be replaced by Ge and Al may be replaced by Ga, B, Fe, Ti, V, and Zr.

The as-synthesized form of ZSM-48 crystals is prepared from a mixture having silica, alumina, base and hexamethonium salt directing agent. In an embodiment, the molar ratio of structural directing agent:silica in the mixture is less than 0.05, or less than 0.025, or less than 0.022. In another embodiment, the molar ratio of structural directing agent:silica in the mixture is at least 0.01, or at least 0.015, or at least 0.016. In still another embodiment, the molar ratio of structural directing agent:silica in the mixture is from 0.015 to 0.025, preferably 0.016 to 0.022. In an embodiment, the as-synthesized form of ZSM-48 crystals has a silica:alumina molar ratio of 70 to 110. In still another embodiment, the as-synthesized form of ZSM-48 crystals has a silica:alumina molar ratio of at least 70, or at least 80, or at least 85. In yet another embodiment, the as-synthesized form of ZSM-48 crystals has a silica:alumina molar ratio of 110 or less, or 100 or less, or 95 or less. For any given preparation of the as-synthesized form of ZSM-48 crystals, the molar composition will contain silica, alumina and directing agent. It should be noted that the as-synthesized form of ZSM-48 crystals may have molar ratios slightly different from the molar ratios of reactants of the reaction mixture used to prepare the as-synthesized form. This result may occur due to incomplete incorporation of 100% of the reactants of the reaction mixture into the crystals formed (from the reaction mixture).

The ZSM-48 composition is prepared from an aqueous reaction mixture comprising silica or silicate salt, alumina or soluble aluminate salt, base and directing agent. To achieve the desired crystal morphology, the reactants in reaction mixture have the following molar ratios:

$SiO_2$:$Al_2O_3$ (preferred)=70 to 110
$H_2O$: $SiO_2$=1 to 500
OH—: $SiO_2$=0.1 to 0.3
OH—: $SiO_2$ (preferred)=0.14 to 0.18
template: $SiO_2$=0.01-0.05
template: $SiO_2$ (preferred)=0.015 to 0.025

In the above ratios, two ranges are provided for both the base:silica ratio and the structure directing agent:silica ratio. The broader ranges for these ratios include mixtures that result in the formation of ZSM-48 crystals with some quantity of Kenyaite and/or needle-like morphology. For situations where Kenyaite and/or needle-like morphology is not desired, the preferred ranges should be used.

The silica source is preferably precipitated silica and is commercially available from Degussa. Other silica sources include powdered silica including precipitated silica such as Zeosil® and silica gels, silicic acid colloidal silica such as Ludox® or dissolved silica. In the presence of a base, these other silica sources may form silicates. The alumina may be in the form of a soluble salt, preferably the sodium salt and is commercially available from US Aluminate. Other suitable aluminum sources include other aluminum salts such as the chloride, aluminum alcoholates or hydrated alumina such as gamma alumina, pseudobohemite and colloidal alumina. The base used to dissolve the metal oxide can be any alkali metal hydroxide, preferably sodium or potassium hydroxide, ammonium hydroxide, diquaternary hydroxide and the like. The directing agent is a hexamethonium salt such as hexamethonium dichloride or hexamethonium hydroxide. The anion (other than chloride) could be other anions such as hydroxide, nitrate, sulfate, other halide and the like. Hexamethonium dichloride is N,N,N,N',N',N'-hexamethyl-1,6-hexanediammonium dichloride.

In an embodiment, the crystals obtained from the synthesis according to the invention have a morphology that is free of fibrous morphology. Fibrous morphology is not desired, as this crystal morphology inhibits the catalytic dewaxing activity of ZSM-48. In another embodiment, the crystals obtained from the synthesis according to the invention have a morphology that contains a low percentage of needle-like morphology. The amount of needle-like morphology present in the ZSM-48 crystals can be 10% or less, or 5% or less, or 1% or less. In an alternative embodiment, the ZSM-48 crystals can be free of needle-like morphology. Low amounts of needle-like crystals are preferred for some applications as needle-like crystals are believed to reduce the activity of ZSM-48 for some types of reactions. To obtain a desired morphology in high purity, the ratios of silica:alumina, base:silica and directing agent:silica in the reaction mixture according to embodiments of the invention should be employed. Additionally, if a composition free of Kenyaite and/or free of needle-like morphology is desired, the preferred ranges should be used.

The as-synthesized ZSM-48 crystals should be at least partially dried prior to use or further treatment. Drying may be accomplished by heating at temperatures of from 100 to 400° C., preferably from 100 to 250° C. Pressures may be atmospheric or subatmospheric. If drying is performed under partial vacuum conditions, the temperatures may be lower than those at atmospheric pressures.

Catalysts are typically bound with a binder or matrix material prior to use. Binders are resistant to temperatures of the use desired and are attrition resistant. Binders may be catalytically active or inactive and include other zeolites, other inorganic materials such as clays and metal oxides such as alumina, silica, titanic, zirconia, and silica-alumina Clays may be kaolin, bentonite and montmorillonite and are commercially available. They may be blended with other materials such as silicates. Other porous matrix materials in addition to silica-aluminas include other binary materials such as silica-magnesia, silica-thoria, silica-zirconia, silica-beryllia and silica-titania as well as ternary materials such as silica-alumina-magnesia, silica-alumina-thoria and silica-alumina-zirconia. The matrix can be in the form of a co-gel. The bound ZSM-48 framework alumina will range from 0.1 wt % to 3.33 wt % framework alumina.

ZSM-48 crystals as part of a catalyst may also be used with a metal hydrogenation component. Metal hydrogenation components may be from Groups 6-12 of the Periodic Table based on the IUPAC system having Groups 1-18, preferably Groups 6 and 8-10. Examples of such metals include Ni, Mo, Co, W, Mn, Cu, Zn, Ru, Pt or Pd, preferably Pt or Pd. Mixtures of hydrogenation metals may also be used such as Co/Mo, Ni/Mo, Ni/W and Pt/Pd, preferably Pt/Pd. The amount of hydrogenation metal or metals may range from 0.1 to 5 wt %, based on catalyst. In an embodiment, the amount of metal or metals is at least 0.1 wt %, or at least 0.25 wt %, or at least 0.5 wt %, or at least 0.6 wt %, or at least 0.75 wt %, or at least 0.9 wt %. In another embodiment, the amount of metal or metals is 5 wt % or less, or 4 wt % or less, or 3 wt % or less, or 2 wt % or less, or 1 wt % or less. Methods of loading metal onto ZSM-48 catalyst are well known and include, for example, impregnation of ZSM-48 catalyst with a metal salt of the hydrogenation component and heating. The ZSM-48 catalyst containing hydrogenation metal may also be sulfided prior to use.

High purity ZSM-48 crystals made according to the above embodiments have a relatively low silica:alumina ratio. The silica:alumina ratio can be 110 or less, or 90 or less, or 75 or less. This lower silica:alumina ratio means that the present catalysts are more acidic. In spite of this increased acidity, they have superior activity and selectivity as well as excellent yields. They also have environmental benefits from the standpoint of health effects from crystal form and the small crystal size is also beneficial to catalyst activity.

For catalysts according to the invention that incorporate ZSM-23, any suitable method for producing ZSM-23 with a low $SiO_2$:$Al_2O_3$ ratio may be used. U.S. Pat. No. 5,332,566 provides an example of a synthesis method suitable for producing ZSM-23 with a low ratio of $SiO_2$:$Al_2O_3$. For example, a directing agent suitable for preparing ZSM-23 can be formed by methylating iminobispropylamine with an excess of iodomethane. The methylation is achieved by adding the iodomethane dropwise to iminobispropylamine which is solvated in absolute ethanol. The mixture is heated to a reflux temperature of 77° C. for 18 hours. The resulting solid product is filtered and washed with absolute ethanol.

The directing agent produced by the above method can then be mixed with colloidal silica sol (30% $SiO_2$), a source of alumina, a source of alkali cations (such as Na or K), and deionized water to form a hydrogel. The alumina source can be any convenient source, such as alumina sulfate or sodium aluminate. The solution is then heated to a crystallization temperature, such as 170° C., and the resulting ZSM-23 crystals are dried. The ZSM-23 crystals can then be combined with a low surface area binder to form a catalyst according to the invention.

The following are examples of the present disclosure and are not to be construed as limiting.

EXAMPLES

Example 1A

Synthesis of ZSM-48 Crystals with $SiO_2/Al_2/O_3$ Ratio of ~70/1 and Preferred Morphology A mixture was prepared from a mixture of DI water, Hexamethonium Chloride (56% solution), Ultrasil silica, Sodium Aluminate solution (45%), and 50% sodium hydroxide solution, and ~0.15% (to reaction mixture) of ZSM-48 seed crystals. The mixture had the following molar composition:

| | |
|---|---|
| $SiO2/SiO_2/Al_2O_3$ | ~80 |
| $H_2O/SiO_2$ | ~15 |
| $OH^-/SiO_2$ | ~0.15 |
| $Na^+/SiO_2$ | ~0.15 |
| Template/$SiO_2$ | ~0.02 |

The mixture was reacted at 320° F. (160° C.) in a 5-gal autoclave with stirring at 250 RPM for 48 hours. The product was filtered, washed with deionized (DI) water and dried at 250° F. (120° C.). The XRD pattern of the as-synthesized material showed the typical pure phase of ZSM-48 topology. The SEM of the as-synthesized material shows that the material was composed of agglomerates of small irregularly shaped crystals (with an average crystal size of about 0.05 microns). The resulting ZSM-48 crystals had a $SiO_2/Al_2O_3$ molar ratio of ~71. The as-synthesized crystals were converted into the hydrogen form by three ion exchanges with ammonium nitrate solution at room temperature, followed by drying at 250° F. (120° C.) and calcination at 1000° F. (540° C.) for 4 hours. The resulting ZSM-48 (70:1 $SiO_2$:$Al_2O_3$) crystals had a total surface area of ~290 $m^2/g$ (external surface area of ~130 $m^2/g$), and an Alpha value of ~100, ~40% higher than current ZSM-48 (90:1 $SiO_2$: $Al_2O_3$) Alumina crystals. The H-form crystals were then steamed at 700° F., 750° F., 800° F., 900° F., and 1000° F. for 4 hours for activity enhancement and Alpha values of these treated products are shown below:

170 (700° F.), 150 (750° F.), 140 (800° F.), 97 (900° F.), and 25 (1000° F.).

Example 1B

Preparation of the Sour Service Dewaxing Catalyst

The sour service hydroisomerization catalyst was prepared by mixing 65 wt % ZSM-48 (~70/1 $SiO_2/Al_2O_3$, see Example 1A) with 35 wt % P25 $TiO_2$ binder and extruding into a 1/20" quadralobe. This catalyst was then precalcined in nitrogen at 1000° F., ammonium exchanged with ammonium nitrate, and calcined at 1000° F. in full air. The extrudate was then steamed for 3 hours @750° F. in full steam. The steamed catalyst was impregnated to 0.6 wt % platinum via incipient wetness using platinum tetraamine nitrate, dried, and then calcined at 680° F. for 3 hours in air. The ratio of micropore surface area to total surface area is about 45%.

Examples 2-5 demonstrate the advantages of portions of a reaction system according to an embodiment of the invention. In various embodiments, a dewaxing or hydroisomerization step can be included in both a first, sour reaction stage and a second, non-sour reaction stage. Example 3 demonstrates the advantage of including a dewaxing catalyst in the second stage, while Examples 4 and 5 demonstrate the advantage of including a dewaxing catalyst in the first stage.

Example 2

Table 1 show typical properties of a medium vacuum gas oil (MVGO) feed suitable for processing in an embodiment of the invention.

TABLE 1

MVGO Feed Properties

| Feed Properties | MVGO Feed |
|---|---|
| 700° F. + in Feed (wt %) | 90 |
| Feed Pour Point, ° C. | 30 |
| Solvent Dewaxed Oil Feed Pour Point, ° C. | −19 |
| Solvent Dewaxed Oil Feed 100 ° C. Viscosity, cSt | 7.55 |
| Solvent Dewaxed Oil Feed VI | 57.8 |
| Organic Sulfur in Feed (ppm by weight) | 25,800 |
| Organic Nitrogen in Feed (ppm by weight) | 809 |

Example 3

Comparison Of Hydrotreating/Hydrocracking vs Hydrotreating and Hydrodewaxing/Hydrocracking A MVGO feed as described above was processed using two different catalyst configurations in a pilot plant. Configuration 1 included a bulk hydrotreating catalyst, followed by high pressure separation of hydrotreated product. The liquid portion of the separated hydrotreated product was hydrocracked under typical hydrocracking conditions using zeolite Y based catalysts. Configuration 2 included a bulk hydrotreating catalyst, followed by high pressure separation of hydrotreated product. The liquid portion of the separated hydrotreated product was hydrodewaxed and hydrocracked under typical hydrocracking conditions using zeolite Y based hydrocracking catalyst. The dewaxing catalyst was a ZSM-48 based catalyst. The catalyst included about 65 wt % of ZSM-48 with a 70:1 silica:alumina ratio, 35 wt % of a titania binder, and 0.6 wt % Pt.

Table 2 provided details of 700F+ conversion obtained over the hydrocracking catalyst at constant temperature

TABLE 2

| Configuration | 700 F. + conversion % |
|---|---|
| 1 | 50 |
| 2 | 70 |

Example 4

Comparison of Hydrotreating and Versus Hydrotreating and Dewaxing

This example evaluates the benefits of including a hydroisomerization (HI) catalyst in the initial stage of a reaction system. The dewaxing catalyst was a ZSM-48 based catalyst. The catalyst includes about 65 wt % of ZSM-48 with a 70:1 silica:alumina ratio, 35 wt % of a titania binder, and 0.6 wt % Pt.

A MVGO feed as described above was processed using two different catalyst configurations in a pilot plant. Configuration 1 included a bulk hydrotreating catalyst, followed by high pressure separation of hydrotreated product. The liquid portion of the separated hydrotreated product was hydrocracked under typical hydrocracking conditions using zeolite Y based catalysts. Configuration 2 included a bulk hydrotreating and a hydrodewaxing catalyst, followed by high pressure separation of hydrotreated and hydrodewaxed product. The liquid portion of the separated hydrotreated and hydrodewaxed product was hydrocracked under typical hydrocracking conditions using zeolite Y based hydrocracking catalyst. The dewaxing catalyst was a ZSM-48 based catalyst. The catalyst included about 65 wt % of ZSM-48 with a 70:1 silica:alumina ratio, 35 wt % of a titania binder, and 0.6 wt % Pt.

Table 3 provides details of 700F+ conversion obtained over the hydrocracking catalyst at constant temperature

TABLE 3

| Configuration | 700 F. + conversion % |
|---|---|
| 1 | 48 |
| 2 | 94 |

Example 5

Comparison of Hydrotreating and Versus Hydrotreating and Dewaxing

This example evaluates the benefits of including a hydroisomerization (HI) catalyst in the initial stage of a reaction system. The dewaxing catalyst was a ZSM-48 based catalyst. The catalyst includes about 65 wt % of ZSM-48 with a 70:1 silica:alumina ratio, 35 wt % of a titania binder, and 0.6 wt % Pt.

A MVGO feed as described above was processed using five different catalyst configurations in a pilot plant. Configuration 1 included 30 $cm^3$ of a supported hydrotreating catalyst (KF-848 from Albemarle Catalyst Company) and 30 $cm^3$ of a bulk hydrotreating catalyst. Configuration 2 included the same catalyst combination, but was operated at a different space velocity. Configuration 3 included the same catalyst, and an additional final bed of 15 cc of a ZSM-48 based dewaxing catalyst. Configuration 4 included 30 $cm^3$ of the bulk hydrotreating catalyst followed by 30 $cm^3$ of the supported hydrotreating catalyst. Configuration 5 included 15 $cm^3$ of the dewaxing catalyst, 30 $cm^3$ of the bulk hydrotreating catalyst, and 30 $cm^3$ of the supported hydrotreating catalyst.

Table 4 provides details of a 700+° F. lubricant base oil product and a diesel product generated from processing the MVGO feed using the above configurations. As shown in Table 4, most of the configurations resulted in a lubricant pour point of about 35° C. However, Configuration 3 produced a lubricant with a pour point of about 22° C. Configuration 3 also produced a diesel product with an improved cetane rating and a lower cloud point. In Table 2, the cetane index was calculated according to the procedures in ASTM D976.

TABLE 4

| Configuration | Diesel Cetane Index (D976) | Diesel Cloud Point (° C.) | 700° F. + Lubes Pour Point (° C.) |
|---|---|---|---|
| 1 | 46.5 | −7 | 36 |
| 2 | 46 | −8 | 35 |
| 3 | 49 | −14 | 22 |
| 4 | 47 | 0 | 35 |
| 5 | 46 | −5 | 33 |

Example 6

Example of Improved Diesel Yield for Dewaxing Followed by Hydrocracking

The following example is based on process simulations using a kinetic model. In the simulations, a feedstock is represented as one or more groups of molecules. The groups of molecules are based on the carbon number of the molecules and the molecular class of the molecules. Based on the process conditions selected for the simulation (such as pressure, temperature, hydrogen treat gas rate, and/or space velocity), each group of molecules is reacted according to a reaction order and rate appropriate for the group. Suitable reaction rate data for different types or groups of molecules can be obtained from the published literature, or reaction rate data can be generated experimentally. The products of the reaction calculations for each group of molecules are used to determine an output product in the simulation. In the reaction calculations, aromatics equilibrium can also be considered and used to modify the calculated aromatics content in the product.

The kinetic model was used to investigate the impact of interstage separation on diesel product yield. A pair of similar two-stage configurations were modeled. One configuration did not have interstage separation between the two stages. A simulated fractionation was performed on the effluent from the second stage to determine the yield of various products. The second configuration was similar except for the presence of a high pressure separator between the two stages.

In a first series of simulations, the configuration without interstage separation was modeled. The 700° F.+ conversion for the first stage was set at 13%, while the total conversion from the two stages was varied to determine the yield of 400° F.-700° F. diesel product. This corresponds to a configuration including hydrocracking capability in both the first and second stage. The results from this series of simulations are shown in FIG. 4.

Figure 4:
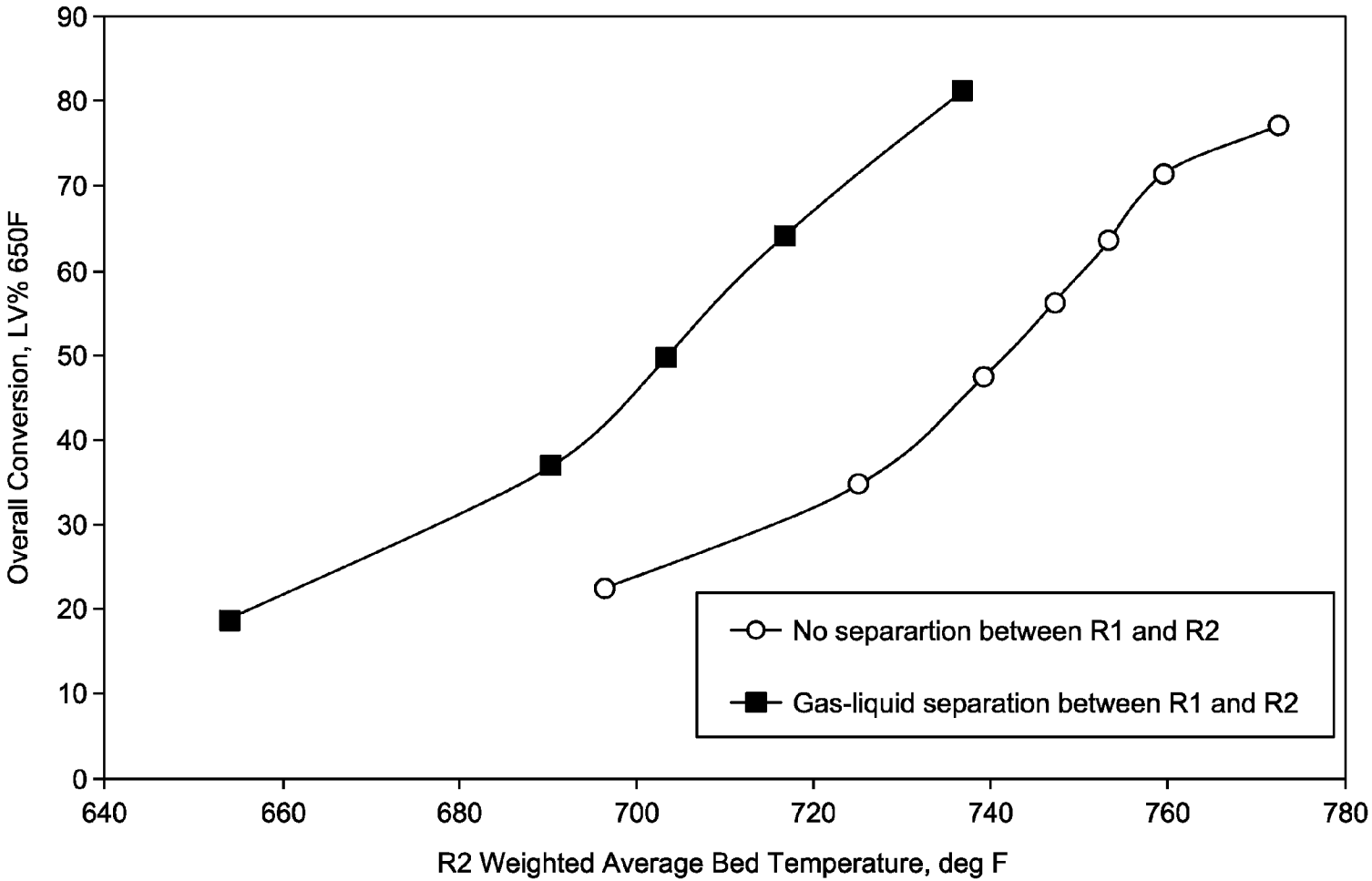
FIG. 4 shows predicted conversion for various processing configurations.

FIG. 4 also shows the second series of simulations, where the configuration including high pressure interstage separation was used. In the second series, the same conversion amounts were used as in the first series. As shown in FIG. 4, the temperature required to achieve the same level of conversion was reduced for the configuration including high pressure interstage separation. The overall diesel and lube yield from the feedstock was predicted to be similar.

Process Example

The following is a prophetic example. A MVGO feed similar to the one described above can be processed in a reaction system having two stages. In the first stage, the feed is hydrotreated under effective hydrotreating conditions. The hydrotreated effluent is then dewaxed in the presence of a dewaxing catalyst suitable for use in sour service. The catalyst can include a bound ZSM-48 zeolite impregnated with less than 1 wt % Pt. The hydrotreated, dewaxed effluent is then hydrocracked under effective hydrocracking conditions using a catalyst based on zeolite Y. The above processes occur without an intermediate separation step.

The hydrocracked effluent is then separated using a high pressure separator. The separation produces a gas phase contaminant portion that includes some of the $H_2S$ and $NH_3$ generated during the hydrotreatment and/or hydrocracking processes. The separation also produces a remaining portion of effluent that can include both gas phase and liquid phase effluent. The remaining portion has a combined gas phase and liquid phase sulfur content of more than 1000 wppm but less than 7500 wppm, preferably less than 5000 wppm, more preferably less than 3000 wppm.

The remaining portion of the effluent is passed into a second reaction stage. In the second stage, the remaining portion is either dewaxed, hydrocracked, or dewaxed and hydrocracked. The effluent from the second stage is fractionated to form a naphtha product, a diesel product, and a lubricant base oil product. Optionally, a portion of the lubricant base oil product is recycled to increase the amount of diesel produced in the second reaction stage. Optionally, the effluent from the second stage can be hydrofinished prior to fractionation.

PCT and EP Clauses:

1. A method for producing a diesel fuel and a lubricant basestock, comprising: contacting a feedstock with a hydrotreating catalyst under effective hydrotreating conditions to produce a hydrotreated effluent; separating the hydrotreated effluent to form a gas phase portion and a remaining portion having at least a liquid phase: dewaxing the remaining portion of the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; hydrocracking the dewaxed effluent under effective hydrocracking conditions; and fractionating the hydrocracked, dewaxed effluent to form at least a naphtha product fraction, a diesel product fraction and a lubricant base oil product fraction.

2. The method of clause 1, wherein a hydrogen gas introduced as part of effective hydrocracking conditions or as part of effective catalytic dewaxing conditions is chosen from a hydrotreated gas effluent, a clean hydrogen gas, a recycle gas and combinations thereof.

3. The method of any one of the preceding clauses, wherein the dewaxing catalyst comprises a molecular sieve having a $SiO_2$:$Al_2O_3$ ratio of 200:1 to 30:1 and comprises from 0.1 wt % to 3.33 wt % framework $Al_2O_3$ content, the dewaxing catalyst including from 0.1 to 5 wt % platinum.

4. The method of any one of the preceding clauses, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

5. The method of any one of the preceding clauses, wherein the dewaxing catalyst comprises at least one high surface area or low surface area metal oxide, refractory binder, the binder being silica, alumina, titania, zirconia, or silica-alumina.

6. The method of any one of the preceding clauses, wherein the metal oxide, refractory binder further comprises a second metal oxide, refractory binder different from the first metal oxide, refractory binder.

7. The method of any one of the preceding clauses, wherein the dewaxing catalyst comprises a micropore surface area to total surface area ratio of greater than or equal to 25%, wherein the total surface area equals the surface area of the external zeolite plus the surface area of the binder, the surface area of the binder being 100 $m^2/g$ or less.

8. The method of any one of the preceding clauses, wherein the hydrocracking catalyst is a zeolite Y based catalyst.

9. A method for producing a diesel fuel and a lubricant basestock, comprising: contacting a feedstock with a hydrotreating catalyst under first effective hydrotreating conditions to produce a hydrotreated effluent; dewaxing the hydrotreated effluent under first effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; hydrocracking at least a portion of the dewaxed effluent under first effective hydrocracking conditions to form a hydrocracked effluent; exposing at least a portion of the hydrocracked effluent to at least one additional hydroprocessing catalyst under one or more effective hydroprocessing conditions to form a hydroprocessed effluent, the one or more effective hydroprocessing conditions being selected from second effective dewaxing conditions and second effective hydrocracking conditions; and fractionating the hydroprocessed effluent to form at least a naphtha product fraction, a diesel product fraction, and a lubricant base oil product fraction.

10. The method of clause 9, wherein the entire dewaxed effluent is cascaded to said hydrocracking step under first effective hydrocracking conditions.

11. The method of clauses 9 or 10, wherein hydrocracking at least a portion of the dewaxed effluent comprises separating the dewaxed effluent to form a gas phase portion and a remaining portion having at least a liquid phase, and hydrocracking the remaining portion of the dewaxed effluent.

12. The method of clauses 9, 10 or 11, wherein exposing at least a portion of the hydrocracked effluent to at least one additional hydroprocessing catalyst comprises separating the hydrocracked effluent to form a gas phase portion and a remaining portion having at least a liquid phase, and hydroprocessing the remaining portion of the hydrocracked effluent.

13. The method of clauses 9, 10, 11 or 12 further comprising hydrofinishing the hydroprocessed effluent under effective hydrofinishing conditions prior to fractionation.

14. A method for producing a diesel fuel and a lubricant basestock, comprising: contacting a feedstock with a hydrotreating catalyst under effective hydrotreating conditions to produce a hydrotreated effluent; separating the hydrotreated effluent to form a first gas phase portion and a first remaining portion having at least a liquid phase; dewaxing the first remaining portion of the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed hydrotreated effluent to form a second gas phase portion and a second remaining portion having at least a liquid phase; hydrocracking the second remaining portion of the dewaxed hydrotreated effluent under effective hydrocracking conditions to form a hydrocracked dewaxed hydrotreated effluent; and fractionating the hydrocracked dewaxed hydrotreated effluent to form at least a naphtha product fraction, a diesel product fraction and a lubricant base oil product fraction.

15. The method of clause 14, wherein a portion of the hydrocracked dewaxed hydrotreated effluent is recycled back to the dewaxing the first remaining portion of the hydrotreated effluent step.

16. The method of clauses 14 or 15, wherein a portion of the hydrocracked dewaxed hydrotreated effluent is recycled back to the separating the dewaxed hydrotreated effluent step.

17. The method of clauses 14, 15, or 16 further including hydrofinishing the hydrocracked dewaxed hydrotreated effluent under effective hydrofinishing conditions prior to the fractionating step.

18. The method of clauses 14, 15, 16, or 17, wherein the first remaining portion of the hydrotreated effluent has a total sulfur content in liquid and gaseous forms of at least 1000 wppm.

19. A method for producing a diesel fuel and a lubricant basestock, comprising: contacting a feedstock with a hydrotreating catalyst under effective hydrotreating conditions to produce a hydrotreated effluent; dewaxing the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed hydrotreated effluent to form a gas phase portion and a remaining portion having at least a liquid phase; hydrocracking the remaining portion of the dewaxed hydrotreated effluent under effective hydrocracking conditions to form a hydrocracked dewaxed hydrotreated effluent; and fractionating the hydrocracked dewaxed hydrotreated effluent to form at least a naphtha product fraction, a diesel product fraction and a lubricant base oil product fraction.

20. A method for producing a diesel fuel and a lubricant basestock, comprising: contacting a feedstock with a hydrotreating catalyst under first effective hydrotreating conditions to produce a hydrotreated effluent; dewaxing the hydrotreated effluent under first effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed effluent to form a gas phase portion and a remaining portion having at least a liquid phase: hydrocracking at least a portion of the remaining portion of the dewaxed effluent under first effective hydrocracking conditions to form a hydrocracked effluent; exposing at least a portion of the hydrocracked effluent to at least one additional hydroprocessing catalyst under one or more effective hydroprocessing conditions to form a hydroprocessed effluent, the one or more effective hydroprocessing conditions being selected from second effective dewaxing conditions and second effective hydrocracking conditions; and fractionating the hydroprocessed effluent to form at least a naphtha product fraction, a diesel product fraction, and a lubricant base oil product fraction.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A method for producing a diesel fuel and a lubricant basestock, comprising:

contacting a feedstock with a hydrotreating catalyst under effective hydrotreating conditions to produce a hydrotreated effluent;

separating the hydrotreated effluent to form a gas phase portion and a remaining portion having at least a liquid phase:

dewaxing the remaining portion of the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof;

hydrocracking the dewaxed effluent under effective hydrocracking conditions; and fractionating the hydrocracked, dewaxed effluent to form at least a naphtha product fraction, a diesel product fraction and a lubricant base oil product fraction.

2. The method of claim 1, wherein a hydrogen gas introduced as part of effective hydrocracking conditions or as part of effective catalytic dewaxing conditions is chosen from a hydrotreated gas effluent, a clean hydrogen gas, a recycle gas and combinations thereof.

3. The method of claim 1, wherein the dewaxing catalyst comprises a molecular sieve having a $SiO_2$:$Al_2O_3$ ratio of 200:1 to 30:1 and comprises from 0.1 wt % to 3.33 wt % framework $Al_2O_3$ content, the dewaxing catalyst including from 0.1 to 5 wt % platinum.

4. The method of claim 3, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

5. The method of claim 4, wherein the molecular sieve is ZSM-48, ZSM-23, or a combination thereof.

6. The method of claim 1, wherein the dewaxing catalyst comprises at least one high surface area or low surface area metal oxide, refractory binder, the binder being silica, alumina, titania, zirconia, or silica-alumina.

7. The method of claim 6, wherein the metal oxide, refractory binder further comprises a second metal oxide, refractory binder different from the first metal oxide, refractory binder.

8. The method of claim 6, wherein the dewaxing catalyst comprises a micropore surface area to total surface area ratio of greater than or equal to 25%, wherein the total surface area equals the surface area of the external zeolite plus the surface area of the binder, the surface area of the binder being 100 $m^2/g$ or less.

9. The method of claim 1, wherein the hydrocracking catalyst is a zeolite Y based catalyst.

10. A method for producing a diesel fuel and a lubricant basestock, comprising:

contacting a feedstock with a hydrotreating catalyst under first effective hydrotreating conditions to produce a hydrotreated effluent;

dewaxing the hydrotreated effluent under first effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof;

hydrocracking at least a portion of the dewaxed effluent under first effective hydrocracking conditions to form a hydrocracked effluent;

exposing at least a portion of the hydrocracked effluent to at least one additional hydroprocessing catalyst under one or more effective hydroprocessing conditions to form a hydroprocessed effluent, the one or more effective hydroprocessing conditions being selected from second effective dewaxing conditions and second effective hydrocracking conditions; and fractionating the hydroprocessed effluent to form at least a naphtha product fraction, a diesel product fraction, and a lubricant base oil product fraction.

11. The method of claim 10, wherein the entire dewaxed effluent is cascaded to said hydrocracking step under first effective hydrocracking conditions.

12. The method of claim 10, wherein hydrocracking at least a portion of the dewaxed effluent comprises separating the dewaxed effluent to form a gas phase portion and a remaining portion having at least a liquid phase, and hydrocracking the remaining portion of the dewaxed effluent.

13. The method of claim 10, wherein the entire hydrocracked effluent is cascaded to a stage for said exposing to at least one additional catalyst under effective hydroprocessing conditions.

14. The method of claim 10, wherein exposing at least a portion of the hydrocracked effluent to at least one additional hydroprocessing catalyst comprises separating the hydrocracked effluent to form a gas phase portion and a remaining portion having at least a liquid phase, and hydroprocessing the remaining portion of the hydrocracked effluent.

15. The method of claim 10, wherein the second effective dewaxing conditions include a temperature at least 20° C. lower than the first effective dewaxing conditions.

16. The method of claim 10, wherein the second effective hydrocracking conditions include a temperature at least 20° C. lower than the first effective hydrocracking conditions.

17. The method of claim 10, further comprising hydrofinishing the hydroprocessed effluent under effective hydrofinishing conditions prior to fractionation.

18. The method of claim 10, wherein fractionating to form a lubricant base oil product fraction comprises forming a plurality of lubricant base oil products, including a lubricant base oil product having a viscosity of at least 2 cSt, and a lubricant base oil product having a viscosity of at least 4 cSt suitable for use in engine oils made according to SAE J300 in OW-, 5W-, or 10W-grades.

19. The method of claim 10, wherein the first effective hydrocracking conditions include a temperature of 200° C. to 450° C., a hydrogen partial pressure of 250 psig to 5000 psig (1.8 MPa to 34.6 MPa), a liquid hourly space velocity of 0.2 $hr^{-1}$ to 10 $hr^{-1}$ and a hydrogen treat gas rate of 35.6 $m^3/m^3$ to 1781 $m^3/m^3$ (200 SCF/B to 10,000 SCF/B).

20. The method of claim 10, wherein the first effective dewaxing conditions include a temperature of from 200° C. to 450° C., a hydrogen partial pressure of from 1.8 MPa to 34.6 MPa (250 psi to 5000 psi), a liquid hourly space velocity of from 0.2 to 10 $hr^{-1}$, and a hydrogen circulation rate of from 35.6 to 1781 $m^3/m^3$ (200 to 10,000 scf/B).

21. A method for producing a diesel fuel and a lubricant basestock, comprising:

contacting a feedstock with a hydrotreating catalyst under effective hydrotreating conditions to produce a hydrotreated effluent;

separating the hydrotreated effluent to form a first gas phase portion and a first remaining portion having at least a liquid phase;

dewaxing the first remaining portion of the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof;

separating the dewaxed hydrotreated effluent to form a second gas phase portion and a second remaining portion having at least a liquid phase;

hydrocracking the second remaining portion of the dewaxed hydrotreated effluent under effective hydrocracking conditions to form a hydrocracked dewaxed hydrotreated effluent; and fractionating the hydrocracked dewaxed hydrotreated effluent to form at least a naphtha product fraction, a diesel product fraction and a lubricant base oil product fraction.

22. The method of claim 21, wherein a hydrogen gas introduced as part of effective hydrotreating conditions, effective dewaxing conditions, or effective hydrocracking conditions is chosen from a hydrotreated gas effluent, a clean hydrogen gas, a recycle gas and combinations thereof.

23. The method of claim 21, wherein the dewaxing catalyst comprises a molecular sieve having a $SiO_2$:$Al_2O_3$ ratio of 200:1 to 30:1 and comprises from 0.1 wt % to 3.33 wt % framework $Al_2O_3$ content, the dewaxing catalyst including from 0.1 to 5 wt % platinum.

24. The method of claim 23, wherein the molecular sieve is EU-1, ZSM-35, ZSM-11, ZSM-57, NU-87, ZSM-22, EU-2, EU-11, ZBM-30, ZSM-48, ZSM-23, or a combination thereof.

25. The method of claim 24, wherein the molecular sieve is ZSM-48, ZSM-23, or a combination thereof.

26. The method of claim 21, wherein the dewaxing catalyst comprises at least one high surface area or one low surface area metal oxide, refractory binder, the binder being silica, alumina, titania, zirconia, or silica-alumina.

27. The method of claim 26, wherein the metal oxide, refractory binder further comprises a second metal oxide, refractory binder different from the first metal oxide, refractory binder.

28. The method of claim 26, wherein the dewaxing catalyst comprises a micropore surface area to total surface area ratio of greater than or equal to 25%, wherein the total surface area equals the surface area of the external zeolite plus the surface area of the binder, the surface area of the binder being 100 $m^2/g$ or less.

29. The method of claim 21, wherein the hydrocracking catalyst is a zeolite Y based catalyst.

30. The method of claim 21, wherein a portion of the hydrocracked dewaxed hydrotreated effluent is recycled back to the dewaxing the first remaining portion of the hydrotreated effluent step.

31. The method of claim 21, wherein a portion of the hydrocracked dewaxed hydrotreated effluent is recycled back to the separating the dewaxed hydrotreated effluent step.

32. The method of claim 21 further including hydrofinishing the hydrocracked dewaxed hydrotreated effluent under effective hydrofinishing conditions prior to the fractionating step.

33. The method of claim 21, wherein the first remaining portion of the hydrotreated effluent has a total sulfur content in liquid and gaseous forms of at least 1000 wppm.

34. The method of claim 21, wherein the effective hydrotreating conditions include a temperature of from 200° C. to 450° C., hydrogen partial pressure of from 1.8 MPa to 34.6 MPa (250 psi to 5000 psi), a liquid hourly space velocity of from 0.2 to 10 $hr^{-1}$, and a hydrogen circulation rate of from 35.6 to 1781 $m^3/m^3$ (200 to 10,000 scf/B).

35. The method of claim 21, wherein the effective catalytic dewaxing conditions include a temperature of from 200° C. to 450° C., a hydrogen partial pressure of from 1.8 MPa to 34.6 MPa (250 psi to 5000 psi), a liquid hourly space velocity of from 0.2 to 10 $hr^{-1}$, and a hydrogen circulation rate of from 35.6 to 1781 $m^3/m^3$ (200 to 10,000 scf/B).

36. The method of claim 21, wherein the effective hydrocracking conditions include a temperature of 200° C. to 450'C, a hydrogen partial pressure of 250 psig to 5000 psig (1.8 MPa to 34.6 MPa), a liquid hourly space velocity of 0.2 $hr^{-1}$ to 10 $hr^{-1}$, and a hydrogen treat gas rate of 35.6 $m^3/m^3$ to 1781 $m^3/m^3$ (200 SCF/B to 10,000 SCF/B).

37. The method of claim 21, wherein fractionating to form a lubricant base oil product fraction comprises forming a plurality of lubricant base oil products, including a lubricant base oil product having a viscosity of at least 2 cSt, and a lubricant base oil product having a viscosity of at least 4 cSt suitable for use in engine oils made according to SAE J300 in OW-, 5W-, or 10W-grades.

38. A method for producing a diesel fuel and a lubricant basestock, comprising: contacting a feedstock with a hydrotreating catalyst under effective hydrotreating conditions to produce a hydrotreated effluent; dewaxing the hydrotreated effluent under effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof; separating the dewaxed hydrotreated effluent to form a gas phase portion and a remaining portion having at least a liquid phase; hydrocracking the remaining portion of the dewaxed hydrotreated effluent under effective hydrocracking conditions to form a hydrocracked dewaxed hydrotreated effluent; and fractionating the hydrocracked dewaxed hydrotreated effluent to form at least a naphtha product fraction, a diesel product fraction and a lubricant base oil product fraction.

39. A method for producing a diesel fuel and a lubricant basestock, comprising:

contacting a feedstock with a hydrotreating catalyst under first effective hydrotreating conditions to produce a hydrotreated effluent;

dewaxing the hydrotreated effluent under first effective catalytic dewaxing conditions to produce a dewaxed effluent, the dewaxing catalyst includes at least one non-dealuminated, unidimensional, 10-member ring pore zeolite, and at least one Group VI metal, Group VIII metal or combination thereof;

separating the dewaxed effluent to form a gas phase portion and a remaining portion having at least a liquid phase;

hydrocracking at least a portion of the remaining portion of the dewaxed effluent under first effective hydrocracking conditions to form a hydrocracked effluent;

exposing at least a portion of the hydrocracked effluent to at least one additional hydroprocessing catalyst under one or more effective hydroprocessing conditions to form a hydroprocessed effluent, the one or more effective hydroprocessing conditions being selected from second effective dewaxing conditions and second effective hydrocracking conditions; and fractionating the hydroprocessed effluent to form at least a naphtha product fraction, a diesel product fraction, and a lubricant base oil product fraction.

* * * * *